US007098857B2

(12) United States Patent
Zoller et al.

(10) Patent No.: US 7,098,857 B2
(45) Date of Patent: Aug. 29, 2006

(54) ADAPTER FOR ANTENNA STRUCTURES

(75) Inventors: Ortwin Zoller, Altdorf (DE); Alexander Gelman, Fellbach (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 10/820,297

(22) Filed: Apr. 7, 2004

(65) Prior Publication Data

US 2004/0239572 A1 Dec. 2, 2004

(30) Foreign Application Priority Data

Apr. 10, 2003 (DE) ..... 103 16 384

(51) Int. Cl.
*H01Q 1/32* (2006.01)

(52) U.S. Cl. ..... 343/713; 343/711

(58) Field of Classification Search ..... 343/713, 343/711, 906, 712

See application file for complete search history.

(56) References Cited

U.S. PATENT DOCUMENTS 4,707,591 A 11/1987 Sprenger
5,521,606 A * 5/1996 Iijima et al. ..... 343/713
6,025,806 A * 2/2000 Deininger et al. ..... 343/713
6,307,515 B1 * 10/2001 Sauer et al. ..... 343/713
6,825,812 B1 * 11/2004 Yokota et al. ..... 343/713
6,903,698 B1 * 6/2005 Silva ..... 343/713

FOREIGN PATENT DOCUMENTS

| | | |
|---|---|---|
| DE | 23 28 167 | 12/1974 |
| DE | 36 04 437 | 8/1987 |
| DE | 196 05 999 | 8/1997 |
| DE | 196 27 052 | 1/1998 |
| DE | 200 19 641 | 5/2001 |
| DE | 100 06 211 | 8/2001 |
| DE | 202 10 286 | 1/2003 |
| EP | 1 206 005 | 5/2002 |

* cited by examiner

*Primary Examiner*—Tan Ho
*Assistant Examiner*—Hung Tran Vy
(74) *Attorney, Agent, or Firm*—Andrew Wilford

(57) ABSTRACT

An adapter for making contact between an antenna structure on a window pane of an automotive vehicle and the antenna signal processing unit which can be positioned at an optional location thereon as plug connectors for flexible leads running to the signal processing window and contact elements which are yieldable and bear against the conductive pads of the antenna structure. The adapter can be mounted at any optional location on the vehicle body.

16 Claims, 3 Drawing Sheets

Fig. 3
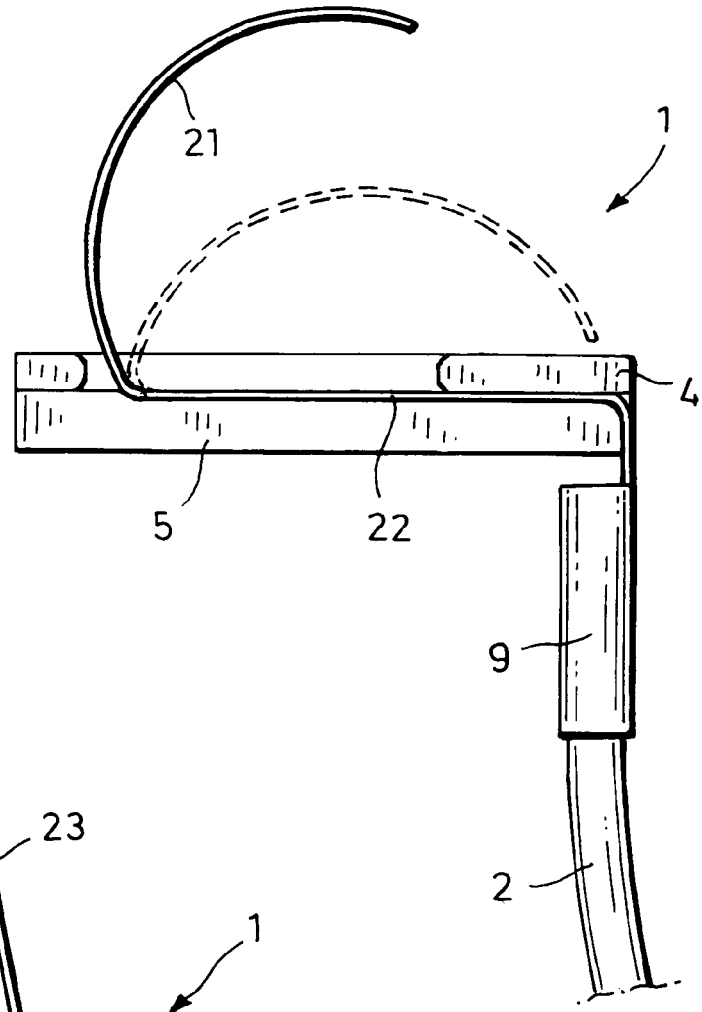
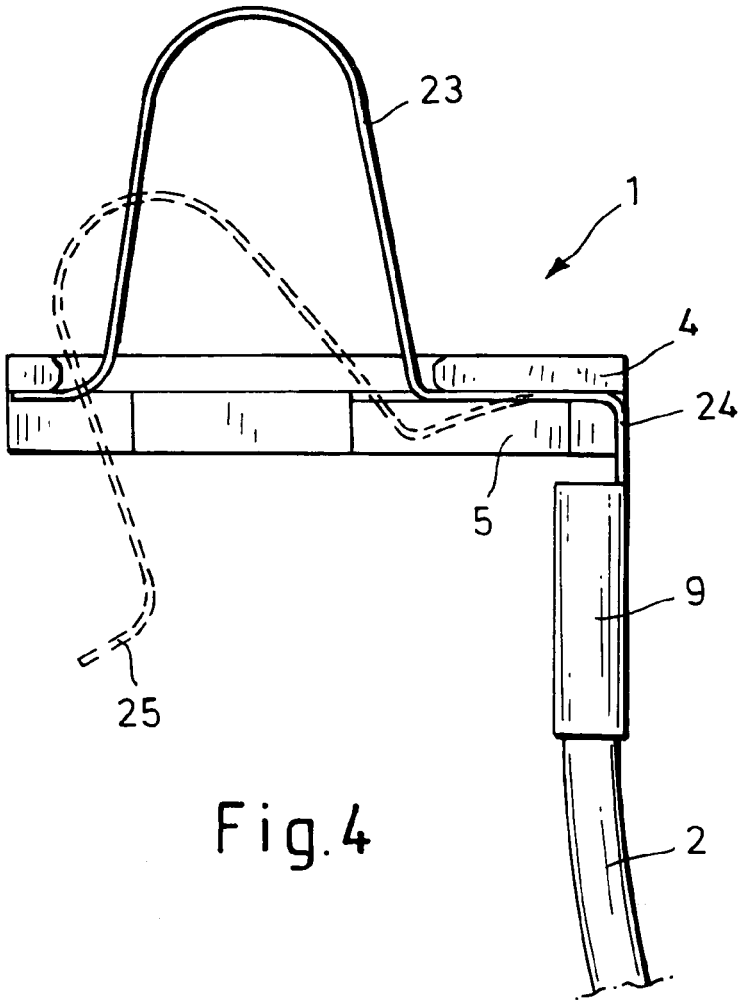
Fig. 4

ADAPTER FOR ANTENNA STRUCTURES

FIELD OF THE INVENTION

The present invention relates to a contact adapter for an antenna structure of a motor vehicle and, more particularly to an antenna assembly for an automotive vehicle having a vehicle body and a panel, especially a window pane, provided with an antenna.

BACKGROUND OF THE INVENTION

German patent document DE 196 05 999 A1 describes the formation of a contact with a flat antenna conductor structure which can be provided, for example, on a window pane of an automotive vehicle. Below a part of the body of the vehicle a signal processing unit, including for example an antenna amplifier, can be mounted by suitable fastener means. The housing of this unit has a support in the form of an outrigger or cantilever arm, at the end of which a contacting device is provided. This contacting device is connected with the signal processing unit by conductors which are disposed in or on the rigid support. The contacting means effects a contact with contact pads or surfaces of the antenna conductor structure provided on the vehicle window pane.

The rigid carrier allows the bridging of a fixed distance between the antenna conductors and the signal processing unit. Because of the rigid nature of the cantilever arm, tolerances have to be met for the positioning of the signal processing unit with respect to the antenna conductor structure. A further drawback of this construction is that the entire signal processing unit with the carrier and the contacting portion of the device mounted on the carrier must be replaced when any part thereof can be damaged, e.g. in the case of a crash. This involves comparatively high cost since the signal processing unit in most cases is integrated into the vehicle body between the vehicle roof and the ceiling structure of the passenger compartment and thus is not readily accessible.

A further drawback is that the rigid geometry of the support and the parts to which it is connected must always be matched to a particular type of vehicle since every vehicle type has its own configuration of the vehicle body. The result of the need to match a particular construction of the processing unit, the cantilever arm and the contact assembly at the end of it to a particular body structure also means that different tools are required for producing the carriers and bodies for each type of vehicle. The result is the need for a large number of tools.

As a general matter, this earlier system has disadvantages with respect to tooling, with respect to the number of different units required for different vehicle types, the manner in which the units are mounted in the vehicle and in the susceptibility of the system to damage.

OBJECTS OF THE INVENTION

It is, therefore, the principal object of the present invention to overcome these drawbacks and provide an improved assembly for connection to the antenna of an automotive vehicle which is capable of obviating the aforementioned disadvantages.

More particularly, it is an object of the invention to provide a connection system between a signal processing unit and an antenna conductor structure for an automotive vehicle and especially one which allows connection to a signal processing unit which can include an antenna amplifier to the antenna conductors which can be simply mounted, can compensate for tolerances and can, in the case of damage, be easily replaced.

Still another object of the invention is to provide an improved system for connecting an antenna to its signal processing unit which is of particular utility in the case in which the antenna conductors are on a window pane of the motor vehicle.

Still another object of the invention is to provide a signal processor for an antenna which can be more randomly located on the vehicle body than has heretofore been the case.

SUMMARY OF THE INVENTION

These objects are achieved, in accordance with the invention in an electrical connection between a signal processing unit which can include an antenna amplifier, and an antenna conductor structure located on or in part of the motor vehicle which comprises at least one adapter which can be mounted in or on an optional part of the vehicle body and is electrically connectable with the signal processing unit and which has at least one contacting means or elements capable of forming the contact with the antenna conductor structure.

According to the invention, the adapter is comprised of an electrically nonconductive material and can have a support on or in which the at least one contacting element is arranged and which is connected by at least one lead or fitting to a signal processing unit directly or which can be connectable to the signal processing unit.

At least one contacting means can be deformable, e.g. yieldable.

The contacting element itself can be connected by a conductor directly to the processing circuit or can bear upon a conductive plate which, in turn, is connected by the lead to the processing circuit. Preferably, however, a plug connector is provided between that contacting element and the conductor and that plug connector can provide a releasable connection (plug and socket connection) or a nonreleasable connection (crimp connector). The contacting element itself may have the configuration of an Ω and can have formations which engage beneath the support directly or beneath a holder on the support which retains the contacting element on the latter.

In particular an antenna assembly according to the invention for an automotive vehicle having a vehicle body and the panel provided with the antenna, can comprise:

an antenna signal-processing unit mounted on the vehicle body;

an adapter mountable upon an optional location on the vehicle body and provided with at least one yieldable contacting element engageable with a conductor on the panel connected electrically with the antenna; and at least one flexible lead connecting the contacting element with the unit.

As has been noted that panel is usually a window pane of the vehicle.

The adapter according to the invention can be mounted anywhere on the vehicle body that is convenient for contacting the antenna conductors and can be independent of the mounting of the signal processing unit on the vehicle body since the connection between the adapter and the signal processing unit is effected via flexible leads for conductors (like braided conductors, strip cables and the like).

The adapter can be anchored in the vehicle body so that upon mounting of the panel, especially a glass pane of the vehicle, the contact pads of the antenna or other conductive locations on the window which are connected with the antenna conductors will come into contact with the contacting element and thus establish the electrical connection between the antenna conductor structure and the signal processor.

The adapter has the advantage that it can be replaced at low cost in case of a defect or upon damage in a crash of the vehicle, especially when it is connected with the leads by a plug connector. Upon release of the plug connection and removal of the defective adapter from the body of the vehicle, an individual adapter can be mounted and connected with those leads.

In addition, damaged vehicle parts can be replaced and for example an individual pane can be engaged with the adapter to automatically restore an electrical connection with an antenna.

The adapter can be held on to the body by any suitable fastening means which may be releasably or permanently in place, for example, screw connectors, clip connectors, an adhesive layer or the like.

In the case where the entire adapter is releasably mounted on an optional part of the vehicle body, in the case of a defect, the entire adapter may be replaced. In the case in which the adapter is not detachable, only the contact elements may be replaced and that of course is also appropriate when the adapter is releasably attached to the vehicle body. That assumes of course that the remaining adapter is not damaged. It is especially of advantage to arrange both the adapter replaceably on the vehicle body and additionally the contact elements replaceably on the adapter.

A further advantage of the invention is the universal applicability of the adapter which can be employed independently of any particular vehicle type. The result is a reduction in tooling costs for the signal-processing unit and an increase in mass production possibility. For any vehicle body it is only necessary to adjust the length of the leads between the adapter and the signal processing unit and thus no changes in the adapter are required for any vehicle body.

BRIEF DESCRIPTION OF THE DRAWING

The above and other objects, features, and advantages will become more readily apparent from the following description, reference being made to the accompanying drawing in which:

FIG. 3 is a section through a second embodiment; and

FIG. 4 is a section through a third embodiment.

SPECIFIC DESCRIPTION

Figure 1:
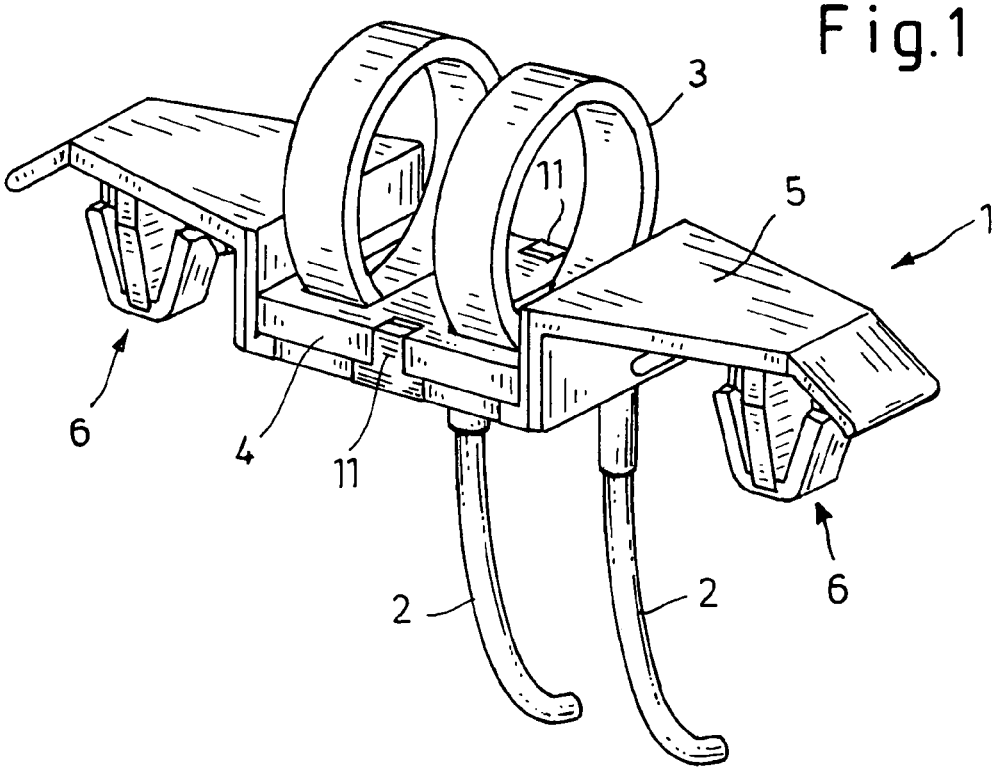
FIG. 1 is a perspective view of a first embodiment of an adapter according to the invention.

FIG. 1 is a perspective view of an adapter 1 according to the invention which can be mounted at any place on a vehicle body or some other portion of the vehicle. In this respect the term "vehicle body" is used to refer to the chassis, the wall and frame structure of the body or any portion of the vehicle adjacent a window pane carrying the antenna.

Figure 2:
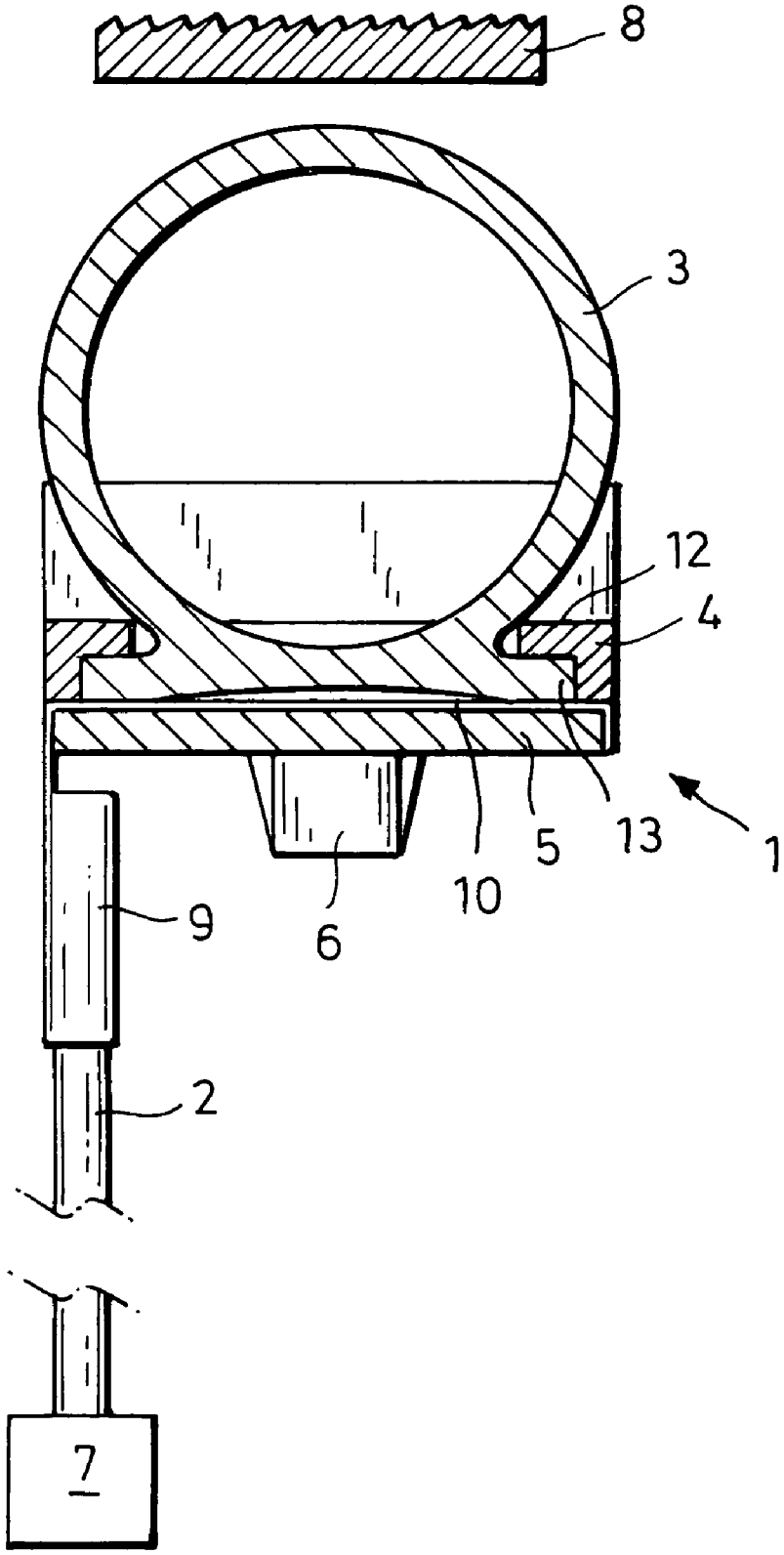
FIG. 2 is a cross sectional view through the embodiment of FIG. 1.

The adapter 1 has at least one lead 2 but preferably two or more leads 2 for connection between the adapter 1 and a signal processing unit, e.g. the unit 7 shown in FIG. 2, but which can include the usual antenna amplifier and may be mounted under the roof of the vehicle or at some other location on the vehicle body. The conductors 2 are, of course, cut to length depending upon the distance between the adapter 1 and the signal processor unit 7.

The adapter 1 is also provided with contacting elements 3 which in the embodiment of FIG. 1, are held in place by an appropriate holder 4 which can be affixed to the body or support 5 of the adapter, e.g. by means of anchors 11. The contact elements 3 are elastically deformable and yieldable, being comprised of an electrically conductive plastic and are electrically connected to the conductors or leads 2 (see FIG. 2, for example). Each contact element 3 bears upon a metal plate 10 which is electrically connected, in turn, to one of the leads 2 through a plug or nonreleasable connector 9.

The support or body 5 is of an electrically nonconducting material and the contact elements 3 are mounted thereon via the holder 4 which has inwardly projecting formations or portions 12 which reach over outwardly projecting formations 13 of the contact elements 3.

Figure 1A:
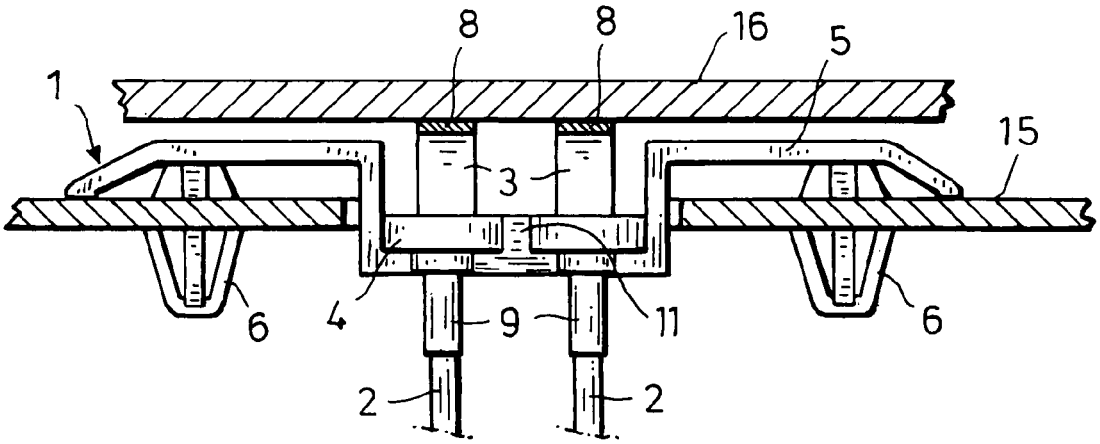
FIG. 1A is a side elevational view showing the adapter in place.

In addition, the support 5 is provided with fastening elements which enable the entire adapter 1 to be affixed to a part of the vehicle body. In the embodiment of FIG. 1 these fastening elements are clips 6 which, as can be seen in FIG. 1A, are pressed through holes in the vehicle body 15 in which the adapter 1 is mounted. Other fastening devices can, of course, be used as a substitute.

From FIG. 2 it can be seen that the contact elements 3 each have the shape generally of an Ω so that the projections 13 of the contact elements can be engaged below the projections 12 of the holder 4. In FIG. 2 as well, we have shown a conductive pad 8 which can bear upon the contact elements 3 and which can be part of an antenna structure formed in or on a window pane 16 of the vehicle (FIG. 1A) and which can be applied to the vehicle body by an adhesive body (not shown) as is standard with some vehicle windows. When the contact pads 8 are applied to the contact elements 3, the latter can be deformed to maintain a contact pressure against the pane 16. At the same time, the antenna structure is electrically connected with the signal-processing unit 7.

If the plug connector 9 is to be nonreleasable from the conductor or lead 2, a crimp or solder connection is provided. Otherwise a detachable plug and socket arrangement can be used. The connectors 9 are integrated in or on the carrier 5 so that the carrier, for example, can be an injection molded around the connectors 9.

The contact plates 10 may be formed in one piece with the connectors 9, for example, as a sheet metal stamping. When the contact elements 3 bear upon the respective plates 10 and simultaneously engage under the deformation pressure of the contact element 3 against the pad 8, a reliable and secure electrically conductive path is established between the pad 8 and the respective conductor 2 via the contacting element 3 and the plate 4. Although it is possible for there to be only one such contacting element 3, plate 4, and pad 8, normally as shown there are two.

FIG. 3 shows an embodiment of the adapter wherein an alternative contact element 21 is indicated which has a bent or bow shape and which can be deflected by engagement with the pad 8 elastically into the broken line position shown. In this case, the contact bow 21 is an extension of a plate 12 retained by the holder 4 on the support 5 and stamped out from sheet metal in one piece with the connector 9, although these parts can be separate. The connector 9 can be detachable or permanently anchored to the conductor 2 in the manner described.

The embodiment of FIG. 4 is similar to that of FIG. 3 except that the contacting element is a deformable metal strip having the configuration of a U and having at its free end a bent foot 25 which can bear against the holder 4 and the support 5. The contact element 23, likewise formed in one piece with the connector 9 can be deformed by engagement with the pad 8 in the manner previously described. The holder 4 or the support 5 can have collars, ribs or other formations capable of retaining the contact element 23 before the application of an external force, e.g. during transport or mounting of the adapter, to limit displacement or damage to the contact element 23 but which can release the latter when deformation thereof is required to form the contact. The contact elements 21 and 23 in FIGS. 3 and 4 are composed of metal but nevertheless are elastically deformable and each have at least one end or strap which can be free to move or can be liberated to be free to move in the formation of the electrical connection.

All of the embodiments can be quickly and simply mounted on a part of the vehicle body and can establish a connection to the antenna structure. When a pane is applied by the releasable plug connection 9 is connected, the adapter 1 can be connected via the leads 2 to the signal-processing unit 7 to make the electrical connections to the signal processor located at any convenient part of the vehicle. Then the window pane 16 can be mounted on the vehicle body 15.

We claim:

1. An antenna-connector assembly for an automotive vehicle having a vehicle body and a panel provided with an antenna-connector pad, said assembly comprising:

an antenna signal-processing unit mounted on said vehicle body remote from the pad;

a dielectric adapter support mountable on said vehicle body facing and spaced from the pad;

a conductive plate on the support facing and spaced from the pad;

at least one elastically yieldable contacting element carried on the plate;

fastener means for securing the support on the vehicle body with the contacting element pressed outward against the pad and inward against the plate; and at least one flexible lead electrically connecting the plate with said unit.

2. The antenna assembly defined in claim 1 wherein said panel is a window pane of said vehicle.

3. The antenna assembly defined in claim 1 wherein said support is provided with two spaced apart yieldable contacting elements respectively engageable with with respective such antenna-connector pads, each of said contacting elements being connected by a respective such plate and flexible lead with said unit.

4. The antenna assembly defined in claim 3 wherein each of said flexible leads is connected to the respective contacting element by a plug connector mounted on said support.

5. The antenna assembly defined in claim 4 wherein said plug connector is a releasable connector.

6. The antenna assembly defined in claim 4 wherein said plug connector is a nonreleasable connector.

7. The antenna assembly defined in claim 6 wherein said plug connector is a crimp connector.

8. The antenna assembly defined in claim 1, further comprising a holder formation on said support retaining said contacting element thereon.

9. The antenna assembly defined in claim 8 wherein said contacting element has a formation engaging in said holder and thereby retaining said contacting element on said support.

10. The antenna assembly defined in claim 1 wherein said contacting element is partly enclosed within and surrounded by said support and is thereby held therein.

11. The antenna assembly defined in claim 1 wherein said contacting element has a formation engaging in said support and thereby retaining said contacting element on said support.

12. The antenna assembly defined in claim 1 wherein said support is provided with such two spaced apart yieldable contacting elements respectively engageable with antenna-connector pads on said panel, each of said contacting elements being connected by a respective such flexible lead and plate with said unit.

13. The antenna assembly defined in claim 12 wherein each of said flexible leads is connected to the respective plate by a plug connector mounted on said support.

14. The antenna assembly defined in claim 1 wherein said contacting element has a formation engaging in said support and thereby retaining said contacting element on said support.

15. The antenna assembly defined in claim 1 wherein the contacting element is made of an electrically conductive plastic and the plate is of metal.

16. The antenna assembly defined in claim 1 wherein the contacting element is of Ω shape.

* * * * *